US011540363B2

(12) United States Patent
Oh et al.

(10) Patent No.: US 11,540,363 B2
(45) Date of Patent: Dec. 27, 2022

(54) MICROWAVE APPLIANCE HAVING A SECONDARY COOKING CHAMBER

(71) Applicant: Haier US Appliance Solutions, Inc., Wilmington, DE (US)

(72) Inventors: Jae Hyun Oh, Seongnam-Si (KR); Geon Ho Kim, Seongnam-Si (KR); Younki Min, Seongnam-si (KR)

(73) Assignee: Haier US Appliance Solutions, Inc., Wilmington, DE (US)

( * ) Notice: Subject to any disclaimer, the term of this patent is extended or adjusted under 35 U.S.C. 154(b) by 508 days.

(21) Appl. No.: 16/679,621

(22) Filed: Nov. 11, 2019

(65) Prior Publication Data

US 2021/0144816 A1 May 13, 2021

(51) Int. Cl.
*H05B 6/64* (2006.01)
*H05B 6/80* (2006.01)

(52) U.S. Cl.
CPC ..... *H05B 6/6402* (2013.01); *H05B 6/6414* (2013.01); *H05B 6/6426* (2013.01)

(58) Field of Classification Search
CPC .. H05B 6/6402; H05B 6/6414; H05B 6/6426; H05B 6/80
USPC ..... 219/678, 691, 695, 696, 697, 702, 720, 219/745, 746, 748, 750, 756, 757, 386, 219/405, 411; 99/326–331, 339, 340, 99/352–355, 357, 448, 467–476, 483; 126/273 A, 21 A, 19 M, 19 R, 20, 275 R, 126/275 E; 312/247
See application file for complete search history.

(56) References Cited

U.S. PATENT DOCUMENTS

| | | | | |
|---|---|---|---|---|
| 2,889,442 | A * | 6/1959 | Schultz | F24C 7/08 312/247 |
| 6,852,963 | B2 * | 2/2005 | Jeong | H05B 6/6458 219/745 |
| 7,345,261 | B2 | 3/2008 | Oh et al. | |
| 9,513,016 | B2 | 12/2016 | Martin | |
| 9,777,928 | B2 | 10/2017 | Boedicker et al. | |
| 2014/0246008 | A1 * | 9/2014 | Martin | F24C 15/027 108/21 |

* cited by examiner

*Primary Examiner* — Quang T Van
(74) *Attorney, Agent, or Firm* — Dority & Manning, P.A

(57) ABSTRACT

A microwave appliance, as provided herein, may include a cabinet, a magnetron, and a drawer liner. The cabinet may define a primary cooking chamber. The magnetron may be mounted within the cabinet in communication with the primary cooking chamber to direct a microwave thereto. The drawer liner may have a side wall joined to a base wall. The drawer liner may be slidably mounted to the cabinet to move along the vertical direction between a contracted position and an expanded position. The side wall may be received within the cabinet in the contracted position. The side wall may define a secondary cooking chamber with the base wall below the primary cooking chamber in the expanded position.

20 Claims, 9 Drawing Sheets

MICROWAVE APPLIANCE HAVING A SECONDARY COOKING CHAMBER

FIELD OF THE INVENTION

The present subject matter relates generally to microwave cooking appliances, such as over-the-range (OTR) microwave appliances.

BACKGROUND OF THE INVENTION

Over the past several decades, microwave cooking appliances (i.e., microwave appliances or microwaves) have become a staple appliance for many, if not most kitchens. Over-the-range (OTR) microwave appliances, which are configured to be mounted above a range appliance or countertop, are especially popular. As with other microwave appliances, OTR microwave appliances generally include a cabinet that defines a cooking chamber for receipt of food items for cooking. In order to provide selective access to the cooking chamber and to contain food particles and cooking energy (e.g., microwaves) during a cooking operation, a door is further included that is typically pivotally mounted to the cabinet. During use, a magnetron can generate the microwave radiation or microwaves that are directed specifically to the cooking chamber. The microwave radiation is typically able to heat and cook food items within the cooking chamber faster than would be possible with conventional cooking methods using direct or indirect heating methods. Moreover, since microwave appliances are often smaller than other appliances (e.g., a conventional baking oven) within a kitchen, microwave appliances are often preferable for heating relatively small portions or amounts of food.

In spite of the advantages provided by microwave appliances, there can be instances where other cooking methods are preferable (e.g., in order to slowly or evenly heat a specific food item). It may, however, be difficult to efficiently cook certain items in the relatively large cabinet of a typical oven or a typical oven may not be available (e.g., due to the size constraints of a kitchen or such an oven may already be in use). Additionally or alternatively, a user may have a need to cook certain food items simultaneously with, but separately from, a food item that is being cooked within the cooking chamber of a microwave appliance. Although such instances may arise not infrequently, a user may be loath to sacrifice additional counter space or storage space to have another relatively small appliance, such as a toaster oven, within their kitchen. Moreover, if a user wished to permanently mount such another relatively small appliance, size and safety constraints (e.g., proximity to a heating element or burner of a range appliance) may be difficult to overcome.

As a result, it would be useful to provide a microwave appliance with a secondary cooking chamber for separately cooking or heating certain food items outside of a primary microwave cooking chamber. Moreover, it may be advantageous for such a secondary cooking chamber to be movable or variable in size relative to the rest of the microwave appliance.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a microwave appliance is provided. The microwave appliance may include a cabinet, a magnetron, and a drawer liner. The cabinet may define a primary cooking chamber. The magnetron may be mounted within the cabinet in communication with the primary cooking chamber to direct a microwave thereto. The drawer liner may have a side wall joined to a base wall. The drawer liner may be slidably mounted to the cabinet to move along the vertical direction between a contracted position and an expanded position. The side wall may be received within the cabinet in the contracted position. The side wall may define a secondary cooking chamber with the base wall below the primary cooking chamber in the expanded position.

In another exemplary aspect of the present disclosure, a microwave appliance is provided. The microwave appliance may include a cabinet, a magnetron, a drawer liner, a primary door, and a secondary door. The cabinet may define a primary cooking chamber. The magnetron may be mounted within the cabinet in communication with the primary cooking chamber to direct a microwave thereto. The drawer liner may have a side wall joined to a base wall. The drawer liner may be mounted to the cabinet. The side wall may define a secondary cooking chamber with the base wall below the primary cooking chamber. The primary door may be pivotably mounted to the cabinet to selectively cover the primary cooking chamber. The secondary door may be movably mounted on the cabinet to move between a lifted position in contact with the primary door and a lowered position covering the secondary cooking chamber below the primary door.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
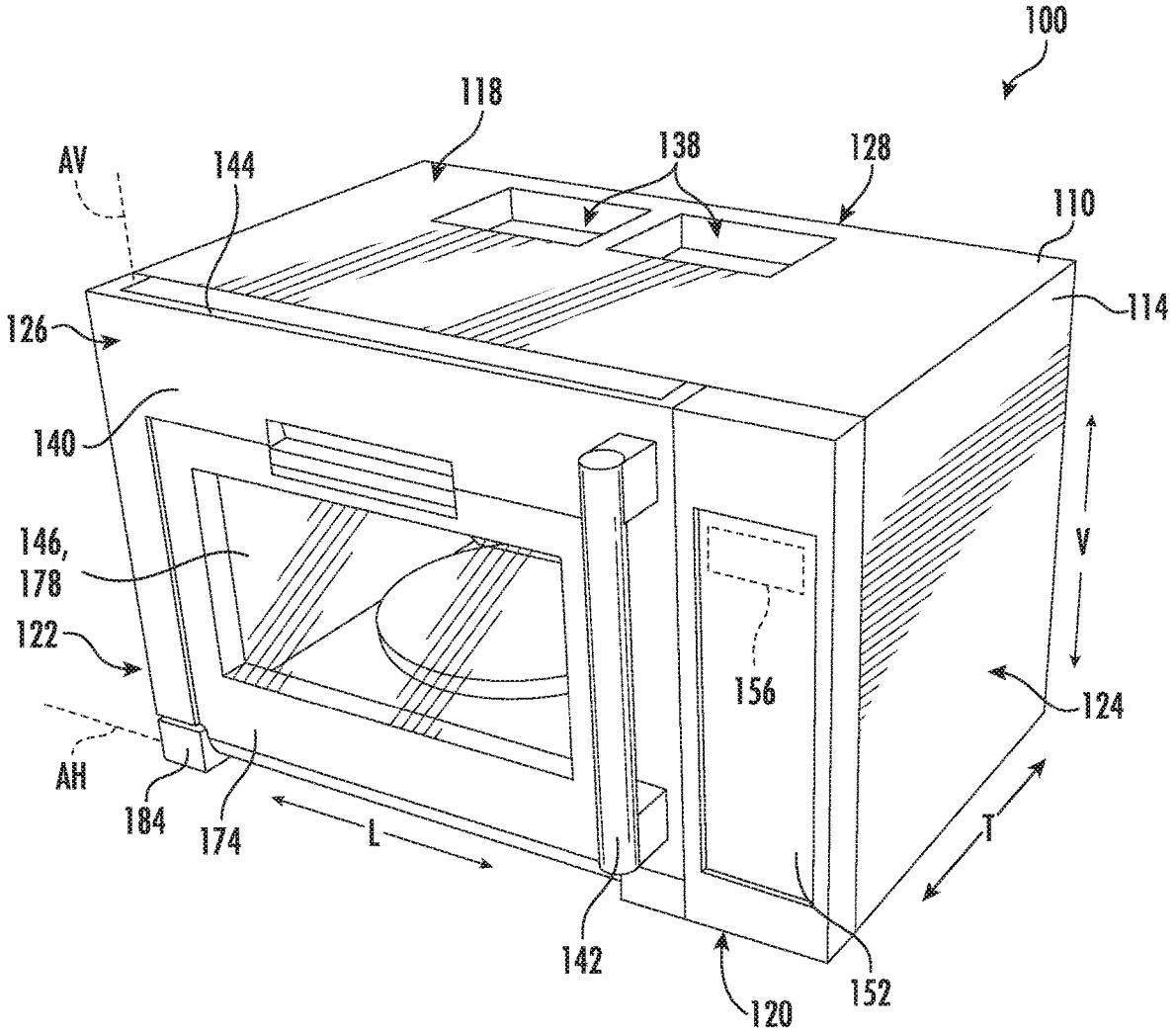
FIG. 1 provides a top perspective view of a microwave appliance according to exemplary embodiments of the present disclosure.
Figure 2:
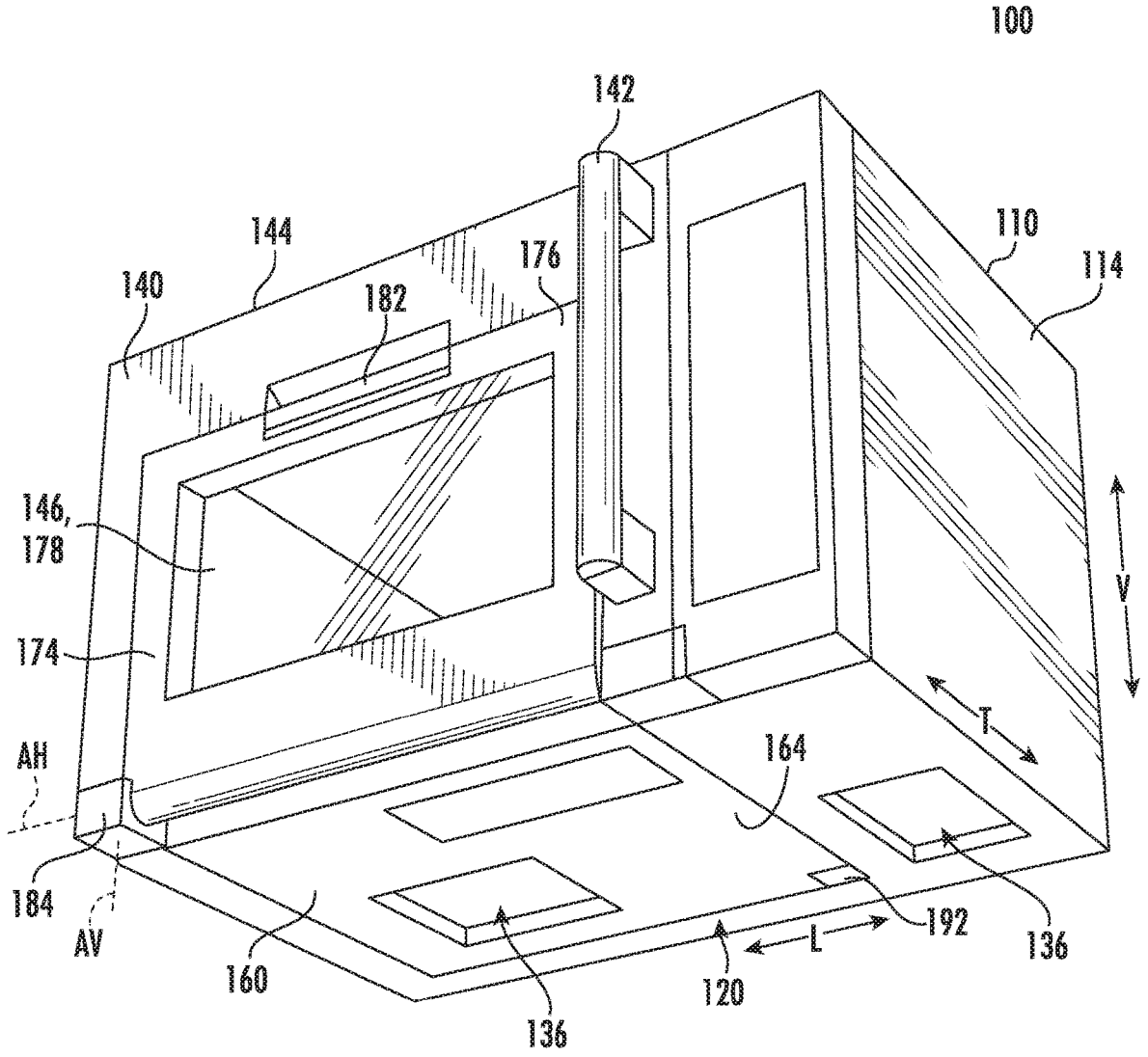
FIG. 2 provides a bottom perspective view of the exemplary microwave appliance of FIG. 1.
Figure 3:
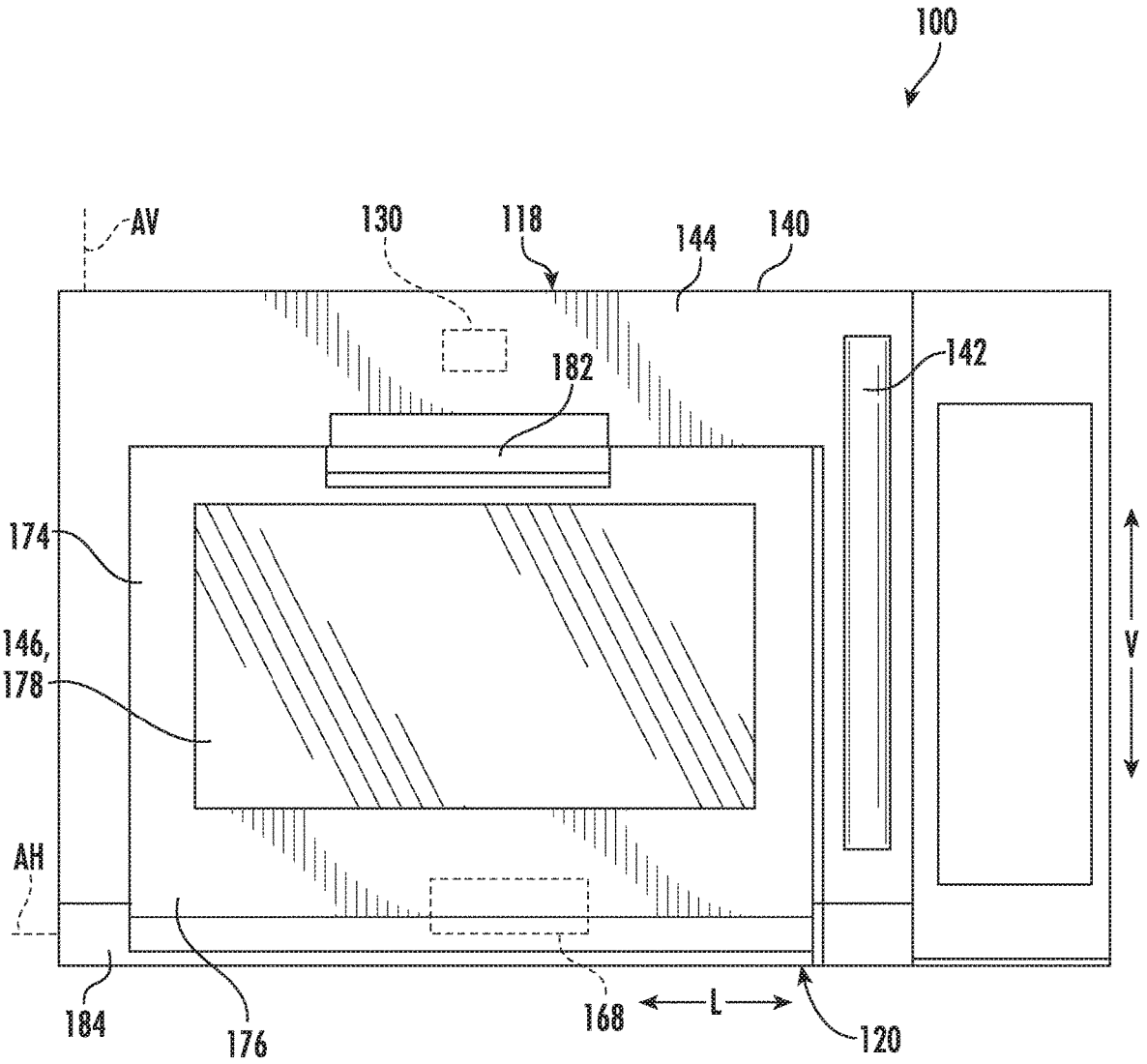
FIG. 3 provides an elevation view of the exemplary microwave appliance of FIG. 1.
Figure 4:
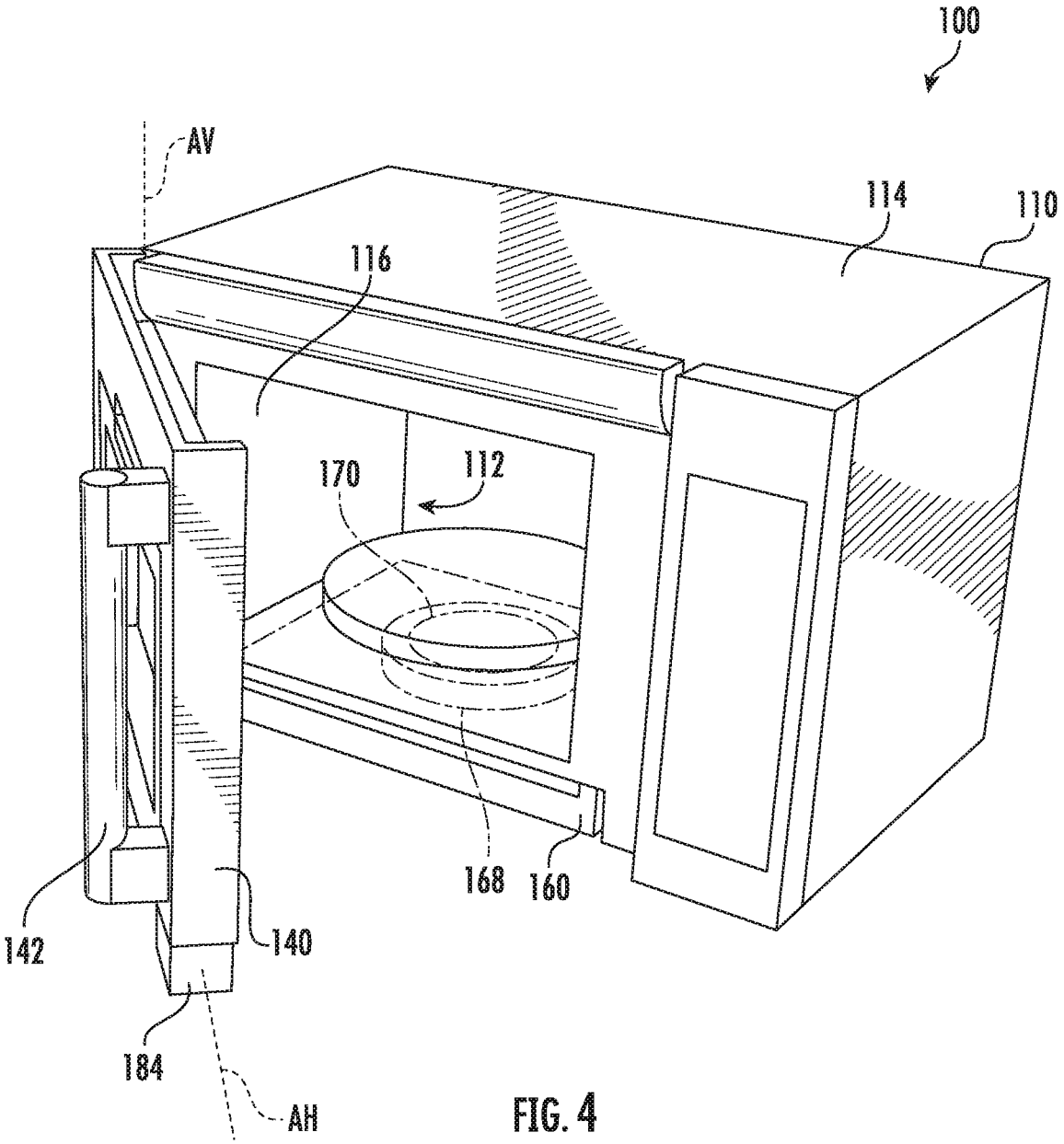
FIG. 4 provides a perspective view of the exemplary microwave appliance of FIG. 1, wherein the primary door is in an open position.
Figure 5:
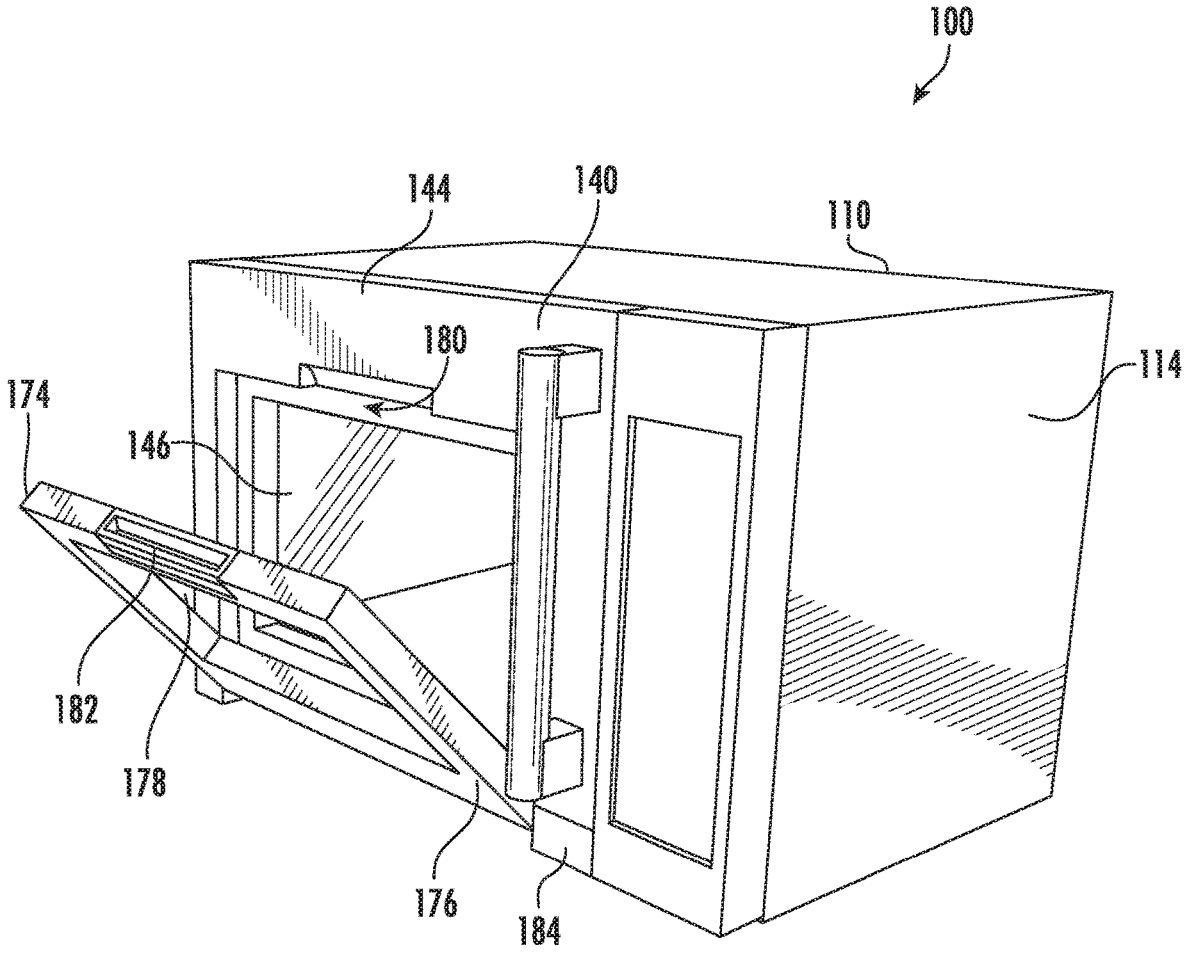
FIG. 5 provides a perspective view of the exemplary microwave appliance of FIG. 1, wherein the secondary door is moved apart from a lifted position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components.

Turning now to the figures, FIGS. 1 through 10 provide various views of a microwave appliance 100 according to exemplary embodiments of the present disclosure. Generally, microwave appliance 100 defines a vertical direction V, a lateral direction L, and a transverse direction T, for example, at a cabinet 110.

As shown, microwave appliance 100 includes a plurality of outer walls (e.g., outer casing 114 of cabinet 110). When assembled, microwave appliance 100 generally extends along the vertical direction V between a top end 118 and a bottom end 120; along the lateral direction L between a first side end 122 and a second side end 124; and along the transverse direction T between a front end 126 and a rear end 128.

Generally, microwave appliance 100 (including cabinet 110) may be sized and configured with one or more mounting features to attach microwave appliance 100 to a wall or cabinet 110 (e.g., above a countertop, cooktop, or range appliance), as is understood. Thus, microwave appliance 100 may be commonly referred to as an over-the-range (OTR) microwave. Nonetheless, except as otherwise indicated, it is understood that the present disclosure is not limited to any specific configuration, shape, or mounting location. For instance, although a generally rectangular shape is illustrated, any suitable shape or style may be adapted to form the structure of outer casing 114.

Within outer casing 114, an internal liner 116 of cabinet 110 defines a primary cooking chamber 112 for receipt of food items for cooking. A magnetron 130 (e.g., cavity magnetron) is mounted within the cabinet 110 in communication with the primary cooking chamber 112 to direct a microwave thereto. Various additional components may be provided with magnetron 130; such as a high voltage transformer, a high voltage capacitor, and a high voltage diode; to produce the electromagnetic radiation from magnetron 130. For instance, the transformer may provide energy from a suitable energy source (such as an electrical outlet) to magnetron 130. Magnetron 130 may convert the energy to electromagnetic radiation, specifically microwave radiation. The capacitor generally connects the magnetron 130 and transformer, such as via high voltage diode, to a chassis. Microwave radiation produced by the magnetron 130 may be then be transmitted through a waveguide to primary cooking chamber 112.

A ventilation air handler may be mounted within a ventilation passage defined through cabinet 110 (e.g., between outer casing 114). As would be understood, the ventilation air handler may be provided as any suitable blower or fan (e.g., radial fan, tangential fan, etc.) positioned within outer casing 114 to actively rotated or motivate air, steam, or exhaust fumes through the ventilation passage. During use, the heat, steam, or exhaust fumes may be motivated by the ventilation air handler from an open region to the ventilation passage through a ventilation inlet 136 into a ventilation outlet 138. Optionally, one or more filters (not pictured) may be provided at ventilation inlet 136 (e.g., between the open region and the ventilation passage) to clean air, steam, or exhaust fumes as such enters outer casing 114. For instance, a grease filter having a suitable coarse filter medium, such as a metallic mesh including aluminum or stainless steel, may be mounted across ventilation inlet 136. Additionally or alternatively, an odor filter having a suitable fine filter medium, such as a mesh or block including activated carbon, may be mounted across ventilation inlet 136. Optionally, the odor filter may be positioned above or downstream from the grease filter.

Microwave appliance 100 includes a primary door 140 that is movably mounted to cabinet 110 in order to permit selective access to primary cooking chamber 112. For instance, primary door 140 can be pivotably mounted to pivot or rotate about a vertical axis AV between an open position (see e.g., FIG. 4) and a closed position (e.g., FIG. 1). The open position permits access to primary cooking chamber 112 while the closed position restricts access to primary cooking chamber 112. Except as otherwise indicated, with respect to the directions (e.g., the vertical direction V, the lateral direction L, and the transverse direction T), the primary door 140 is described in the closed position.

A primary handle 142 may be mounted to or formed on primary door 140 (e.g., at a peripheral body 144 of primary door 140) to assist a user with opening and closing primary door 140. As an example, a user can pull on primary handle 142 to open or close primary door 140 and access or cover primary cooking chamber 112. Additionally or alternatively, microwave appliance 100 may include a door release button (not pictured) that disengages or otherwise pushes open primary door 140 when depressed.

In some embodiments, primary door 140 includes a peripheral body 144 that surrounds or supports a primary window 146. Generally, primary window 146 may be a translucent or transparent panel (e.g., formed from a transparent glass, plastic, etc.) and can provide for viewing the contents of primary cooking chamber 112 when primary door 140 is closed (i.e., in the closed position). Optionally, primary window 146 may further assist with insulating primary cooking chamber 112.

As shown, peripheral body 144 may frame primary window 146 in the transverse direction T and lateral direction L. In other words, peripheral body 144 may extend about a perimeter of primary window 146. At least a portion of peripheral body 144 may hold, for instance, a front panel of primary window 146 in place (e.g., such that movement of the primary window 146 in the transverse direction T relative to the peripheral body 144 is restricted).

As illustrated, a user interface panel 152 may be provided on microwave appliance 100. In some embodiments, user interface panel 152 includes input components or controls, such as one or more of a variety of electrical, mechanical, or electro-mechanical input devices. The controls may include, for example, rotary dials, knobs, push buttons, and touch pads. A controller 156 is in communication with user interface panel 152 and the controls through which a user may select various operational features and modes and monitor progress of microwave appliance 100. In additional or alternative embodiments, user interface panel 152 includes a display component, such as a digital or analog display in communication with a controller 156 and configured to provide operational feedback to a user. In certain embodiments, user interface panel 152 represents a general purpose I/O ("GPIO") device or functional block.

In some embodiments, controller 156 is communicatively coupled (i.e., in operative communication) with user interface panel 152 and its controls. Controller 156 may also be communicatively coupled with various operational components of microwave appliance 100 as well, such as magnetron 130, sensors 192, etc. Input/output ("I/O") signals may be routed between controller 156 and the various operational components of microwave appliance 100. Thus, controller 156 can selectively activate and operate these various components. Various components of microwave appliance 100 are communicatively coupled with controller 156 via one or more communication lines such as, for example, conductive signal lines, shared communication busses, or wireless communications bands.

In some embodiments, controller 156 includes one or more memory devices and one or more processors. The processors can be any combination of general or special purpose processors, CPUs, or the like that can execute programming instructions or control code associated with operation of microwave appliance 100. The memory devices (i.e., memory) may represent random access memory such as DRAM or read only memory such as ROM or FLASH. In one embodiment, the processor executes programming instructions stored in memory. The memory may be a separate component from the processor or may be included onboard within the processor. Alternatively, controller 156 may be constructed without using a processor, for example, using a combination of discrete analog or digital logic circuitry (such as switches, amplifiers, integrators, comparators, flip-flops, AND gates, and the like) to perform control functionality instead of relying upon software.

Generally, controller 156 can be positioned in any suitable location throughout microwave appliance 100. For example, controller 156 may be located proximate user interface panel 152 toward front portion of microwave appliance 100.

Turning now especially to FIGS. 5 through 10, microwave appliance 100 may include a drawer liner 160 that defines a secondary cooking chamber 166 below the primary cooking chamber 112. Specifically, drawer liner 160 may include a side wall 162 joined to a base wall 164 that define a partially enclosed secondary cooking chamber 166 separate (e.g., spaced apart along the vertical direction V) from primary cooking chamber 112 and within which food may be received. Both side wall 162 and base wall 164 may be joined together outside of the internal liner 116. Together, side wall 162 and base wall 164 (e.g., with a bottom portion of outer liner 114) may define an opening that generally permits user access to secondary cooking chamber 166. Optionally, drawer liner 160 may define bottom end 120 of appliance 100 (e.g., at or below base wall 164). Additionally or alternatively, drawer liner 160 defines at least a portion of ventilation inlet 136 (e.g., at or below base wall 164).

A heating element 168 may be provided to selectively heat the air or food within secondary cooking chamber 166. For instance, heating element 168 may be mounted within microwave appliance 100 (e.g., within outer casing 114) and in thermal communication with the secondary cooking chamber 166 such that heat may be transmitted from the heating element 168 to secondary cooking chamber 166 (e.g., via conductive or convective thermal communication). Activation or heat generation of heating element 168 may generally be directed or controlled by controller 156 (e.g., according to one or more commands received at interface panel 152). In some embodiments, heating element 168 is mounted above base wall 164 and at least a portion of side wall 162. Optionally, heating element 168 may be positioned below primary cooking chamber 112 (e.g., beneath internal liner 116) and fluidly or thermally isolated from primary cooking chamber 112.

Generally, heating element 168 is communicatively to controller 156 and may include any suitable non-dielectric heater. For instance, heating element 168 may include a resistive heater element, a halogen element, an infrared radiant element, etc.

In certain embodiments, heating element 168 is housed within a sub-chamber in fluid communication with a convection air handler 170. Convection air handler 170 may include any suitable fan or blower and may generally be directed to heating element 168. Moreover, convection air handler 170 may be communicated to controller 156. During use, such as when one or more food item is being heated within secondary cooking chamber 166, convection air handler 170 may thus be selectively activated (e.g., as directed or command by controller 156) to generate a convection airflow across heating element 168 and within secondary cooking chamber 166.

In optional embodiments, an outlet aperture 172 is defined above and in fluid communication with secondary cooking chamber 166. For instance, outlet aperture 172 may be defined through outer casing 114 or the portion of cabinet 110 otherwise defining the upper surface of secondary cooking chamber 166.

Alternatively, outlet aperture 172 may be defined through an upper portion of side wall 162. Generally, outlet aperture 172 may permit exhaust (e.g., generated by food) within secondary cooking chamber 166 to escape (e.g., as motivated by convection air handler 170). In some such embodiments, outlet aperture 172 extends to the ventilation passage. Air from outlet aperture 172 may thus be directed from secondary cooking chamber 166 and to the ambient environment through the ventilation passage. Additionally or alternatively, a separate passage may be defined through cabinet 110 or outlet aperture 172 may vent directly to the ambient environment.

A secondary door 174 may be mounted on cabinet 110 to selectively cover secondary cooking chamber 166. Specifically, secondary door 174 may move between a lifted position and a lowered position. For instance, secondary door 174 may be pivotably mounted to pivot or rotate about a horizontal axis AH (e.g., perpendicular to the vertical direction V or parallel to the lateral direction L). In the lifted position, secondary door 174 may be held away from (e.g., above) at least a portion of the opening to secondary cooking chamber 166. By contrast, in the lowered position, secondary door 174 may be held in front of or otherwise cover the opening of secondary cooking chamber 166. Optionally, a seal may be formed between and inner surface of secondary door 174 and an outer surface or edge of drawer liner 160 (e.g., such that secondary cooking chamber 166 is at least partially sealed or insulated about the opening of secondary cooking chamber 166).

In some embodiments, secondary door 174 includes a bounding body 176 that surrounds or supports a secondary window 178. Generally, secondary window 178 may be a translucent or transparent panel (e.g., formed from a transparent glass, plastic, etc.) and can provide for viewing the contents of secondary cooking chamber 166 when secondary door 174 is closed (i.e., in the closed position). Optionally, secondary window 178 may further assist with insulating secondary cooking chamber 166 (e.g., in the lowered position).

As shown, bounding body 176 may frame secondary window 178 in the transverse direction T and lateral direction L. In other words, bounding body 176 may extend about a perimeter of secondary window 178. At least a portion of secondary peripheral body 144 may hold, for instance, a front panel of secondary window 178 in place (e.g., such that movement of the secondary window 178 in the transverse direction T relative to bounding body 176 is restricted).

In certain embodiments, secondary door 174 may selectively engage the primary door 140. For instance, in the lifted position, secondary door 174 may contact primary door 140. In some such embodiments, a front surface of primary door 140 defines a relief 180 to receive secondary door 174. In the lifted position, bounding body 176 may sit within peripheral body 144. Optionally, secondary window 178 may align with primary window 146 (e.g., along the transverse direction T). Additionally or alternatively, a mating latch 182 may be provided on secondary door 174 to selectively engage a complementary portion of primary door 140 and releasably lock secondary door 174 (e.g., to primary door 140 and) in the lifted position.

In the lifted position, secondary door 174 may be permitted to rotate with primary door 140 about the vertical axis AV. For instance, secondary door 174 may move in tandem with primary door 140 between the open position and the closed position. In some embodiments, secondary door 174 is rotatably coupled or mounted to a support frame 184 that defines the horizontal axis AH. As show, support frame 184 may be pivotably mounted to cabinet 110 (e.g., at outer casing 114) to pivot or rotate about the vertical axis AV. Thus, support frame 184 may be coaxial with primary door 140. Additionally or alternatively, support frame 184 may be mounted below primary door 140. In spite of being coaxial with or adjacent to primary door 140, support frame 184 may generally pivot independently from primary door 140. Thus, when secondary door 174 is in the lowered position, primary door 140 may freely pivot between the open and closed positions without moving or otherwise affecting secondary door 174. Nonetheless, support frame 184 may still pivot in tandem with primary door 140, for example, when secondary door 174 is engaged with primary door 140 in the lifted position.

Figure 6:
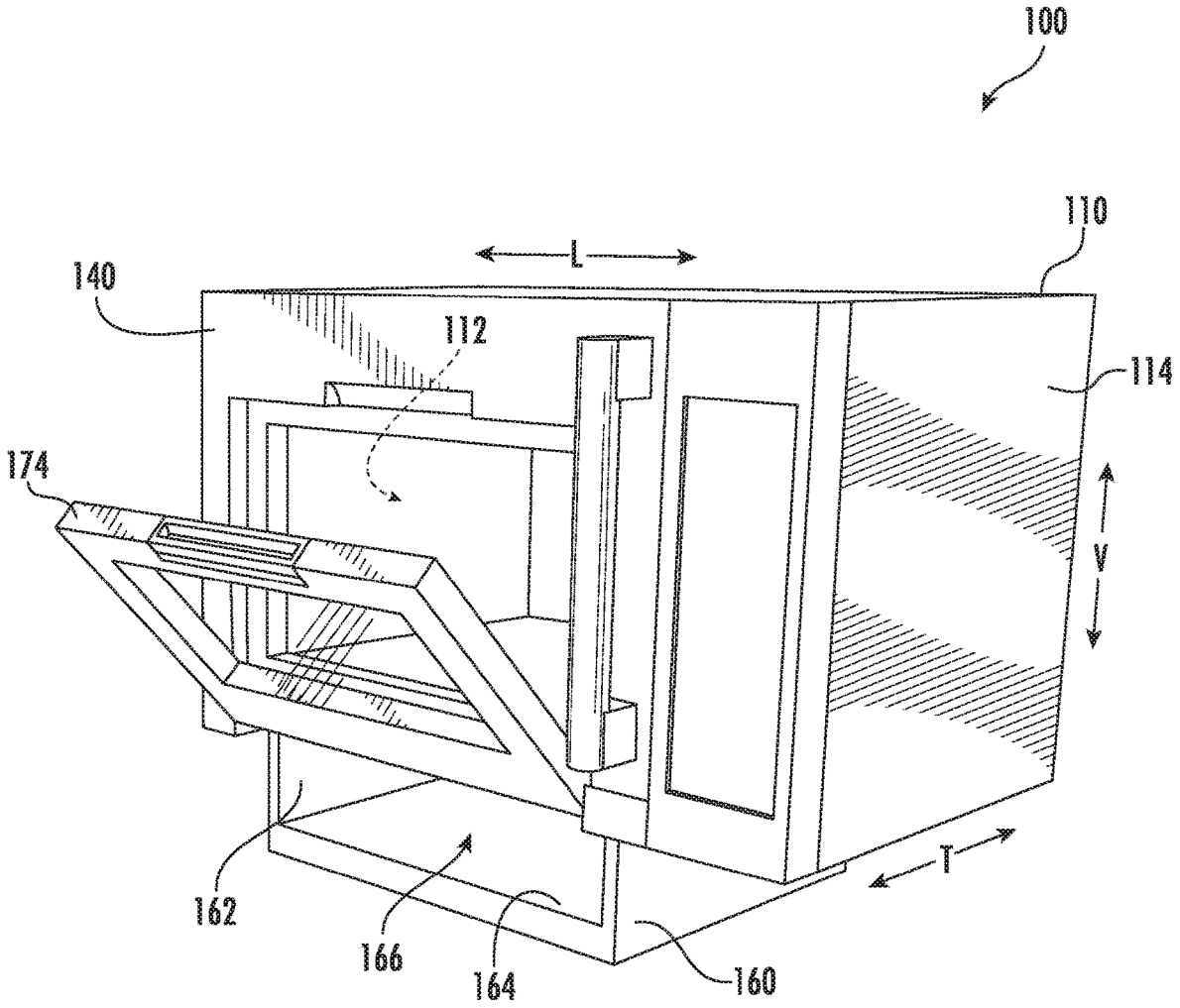
FIG. 6 provides a perspective view of the exemplary microwave appliance of FIG. 1, wherein the drawer liner is moved apart from a contracted position.
Figure 7:
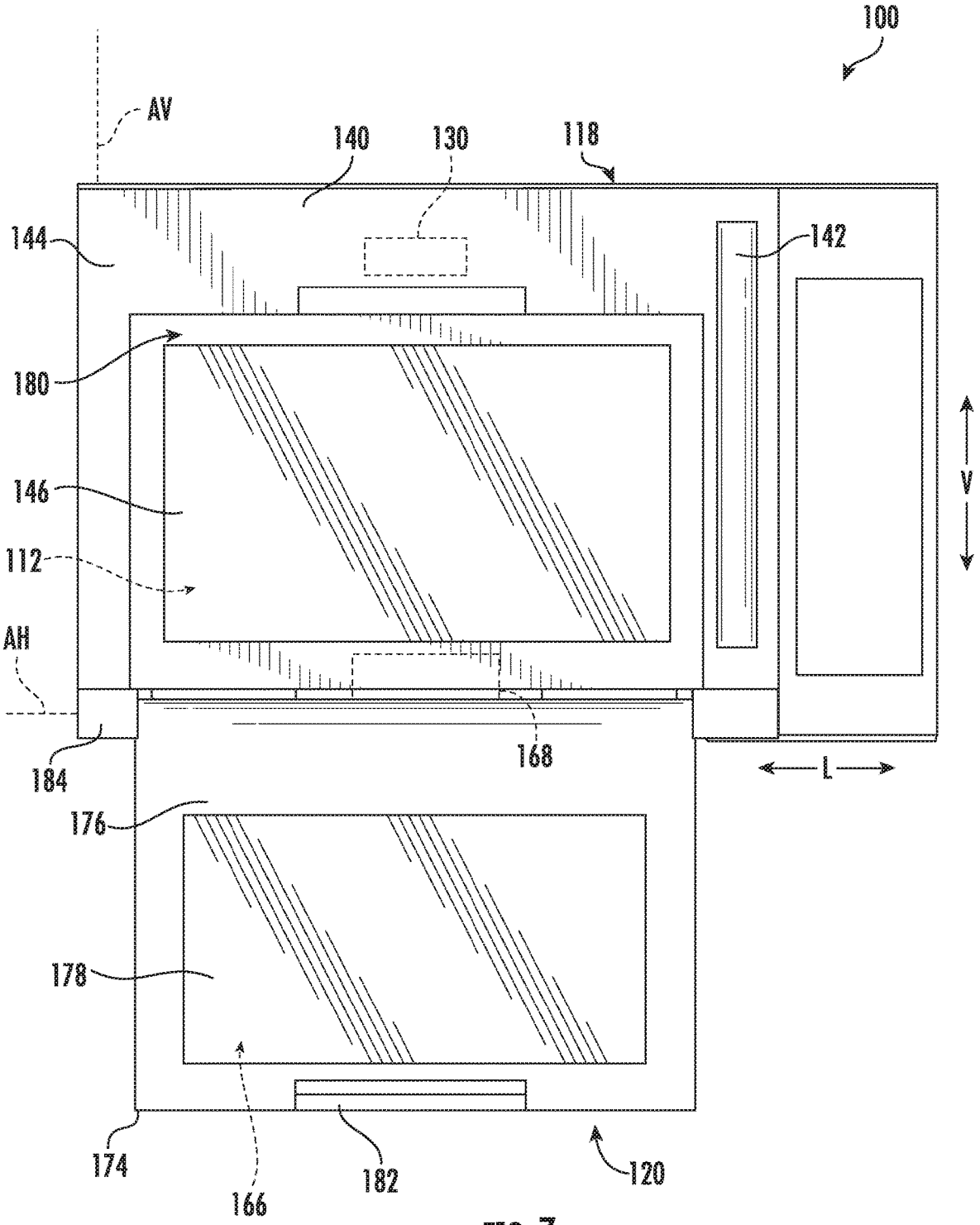
FIG. 7 provides an elevation view of the exemplary microwave appliance of FIG. 1, wherein the drawer liner is in an expanded position and the secondary door is in a lowered position.
Figure 8:
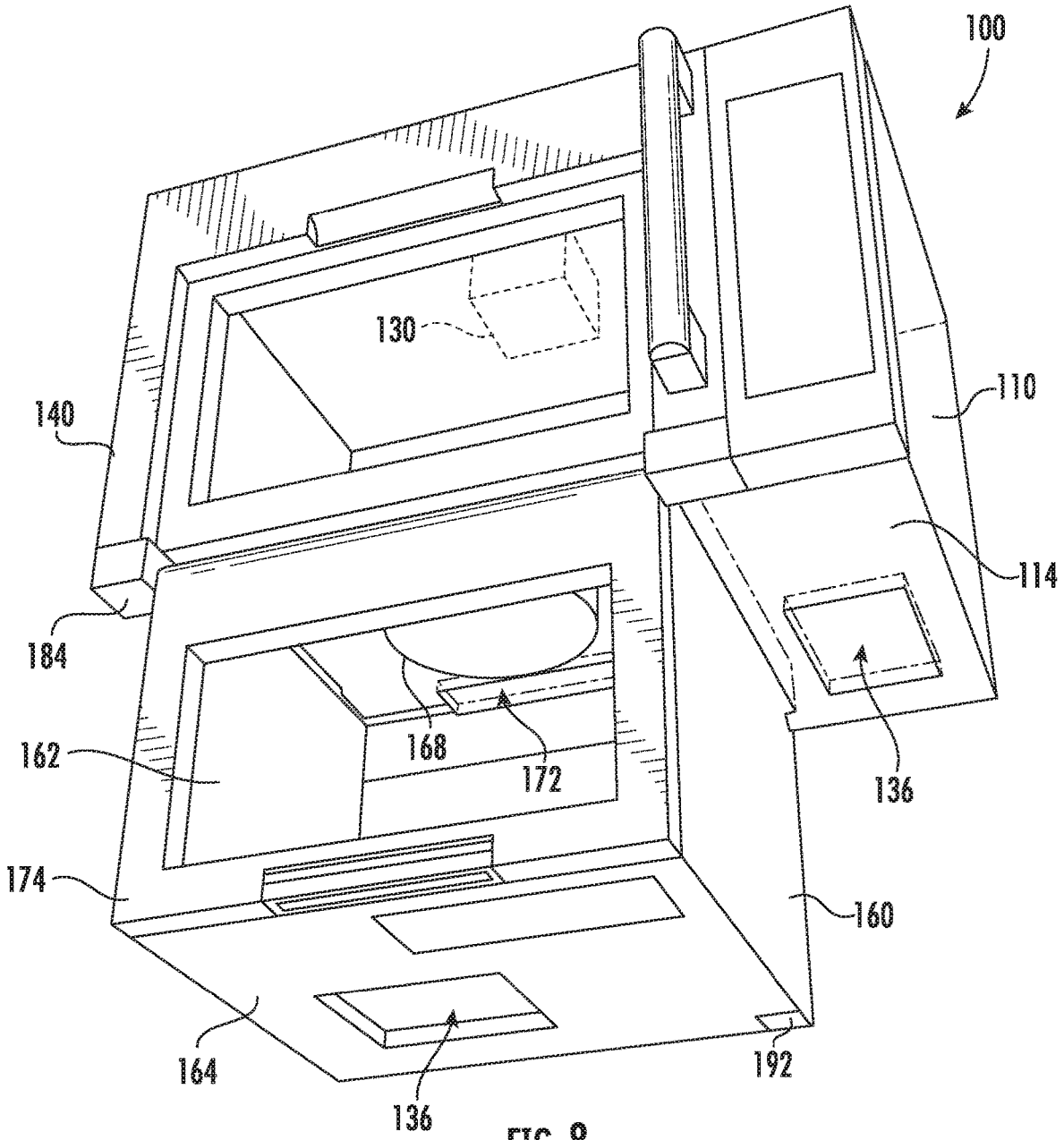
FIG. 8 provides a bottom perspective view of the exemplary microwave appliance of FIG. 7.
Figure 9:
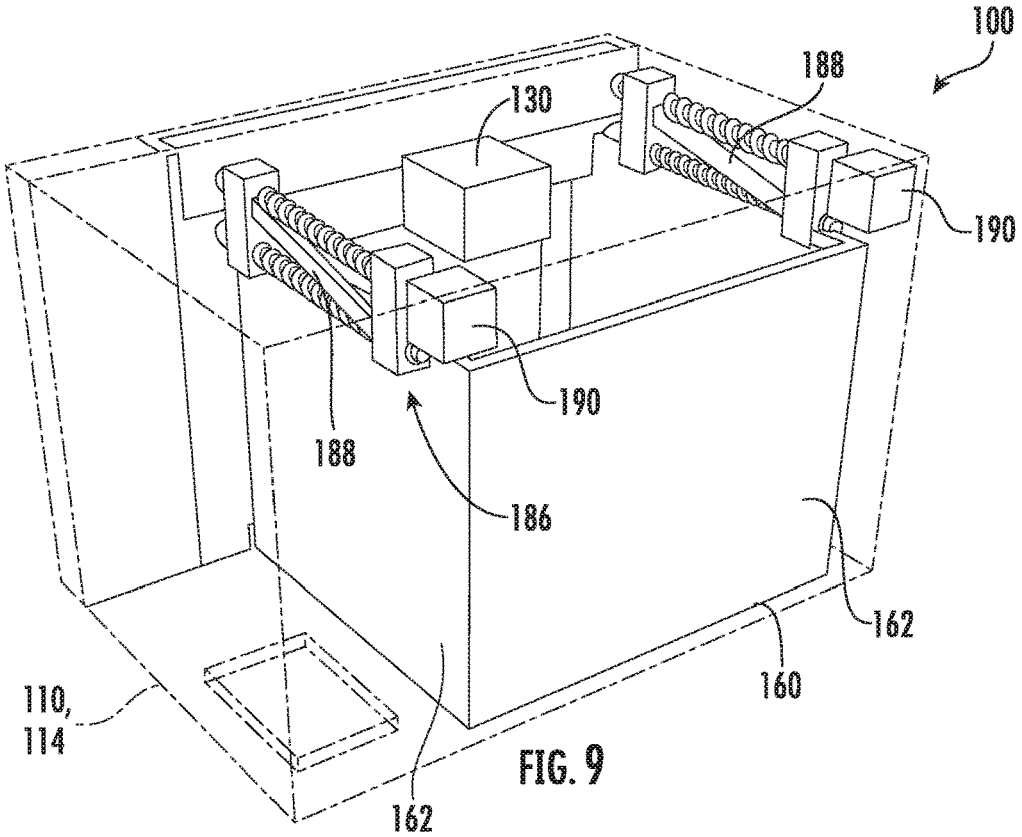
FIG. 9 provides a rear perspective view of the exemplary microwave appliance of FIG. 1, wherein a portion of the cabinet has been removed for clarity.
Figure 10:
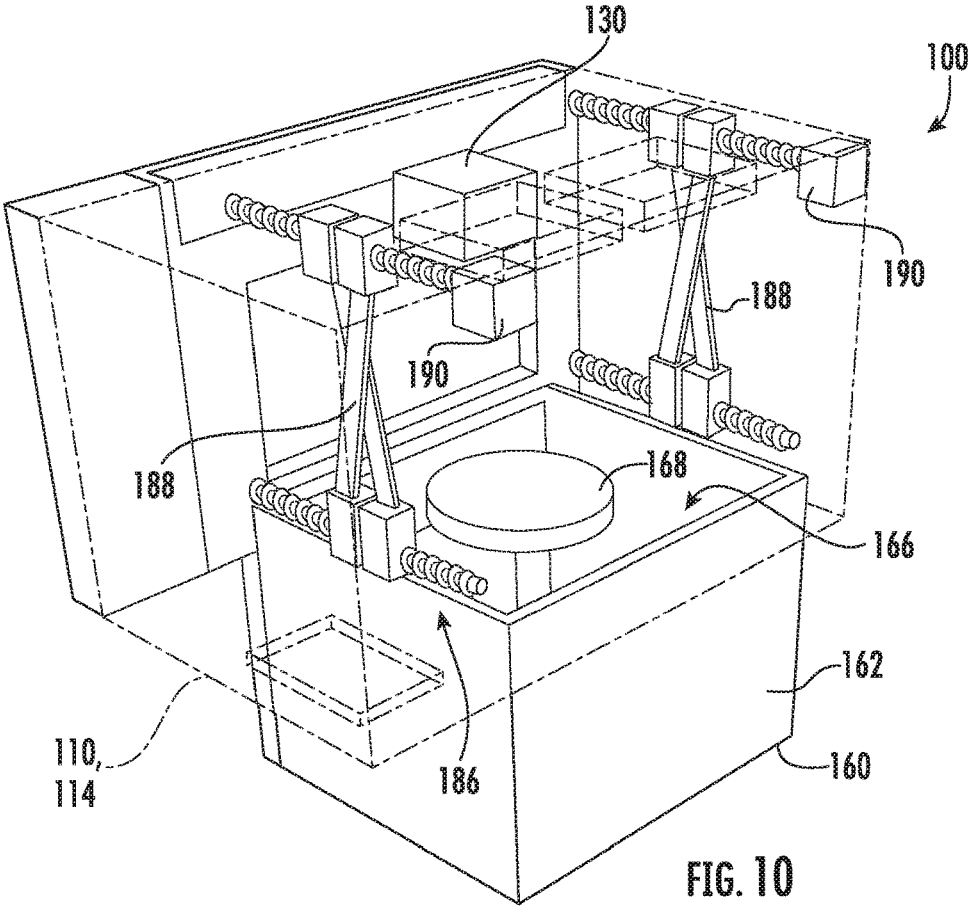
FIG. 10 provides a rear perspective view of the exemplary microwave appliance of FIG. 9, wherein the drawer liner is in the expanded position and the secondary door is in the lowered position.

As illustrated, for instance, in FIGS. 5 through 10, drawer liner 160 may be slidably mounted to cabinet 110 to move between a contracted position (e.g., FIGS. 5 and 9) and an expanded position (e.g., FIGS. 6 and 10). Specifically, drawer liner 160 may be attached to an actuating assembly 186 configured to move drawer liner 160 up/down along the vertical direction V relative to primary cooking chamber 112 or outer casing 114. In the contracted position, side wall 162 is received (e.g., at least partially enclosed or held) within outer casing 114. For instance, side wall 162 may be disposed behind or radially outward from internal liner 116 defining primary cooking chamber 112 (e.g., at a common or overlapping vertical height with primary cooking chamber 112). By contrast, in the expanded position, base wall 164 is spaced apart from a bottom surface of outer casing 114 and side wall 162 extends below primary cooking chamber 112 such that secondary cooking chamber 166 and the opening thereto is defined.

As noted, actuating assembly 186 may be configured to move drawer liner 160 between the contracted and expanded positions. In some embodiments, actuating assembly 186 includes a separate guide-rail 188 at each lateral side ends 122, 124. Generally, guide-rail 188 may be provided as any suitably linear actuating mechanism. For instance, as illustrated in FIGS. 9 and 10, each guide-rail 188 may include or be provided as a scissor lift (e.g., driven by a corresponding worm drive). Such scissor lift guide-rails 188 may be mounted within outer casing 114 and attached to side wall 162 such that, for instance, expansion of the scissor lifts lowers drawer liner 160 (i.e., moves drawer liner 160 toward the expanded position) and contraction of the scissor lifts raises drawer liner 160 (i.e., moves drawer liner 160 to the contracted position). Optionally, guide-rails 188 may be mechanically coupled to one or more electrically-driven motors 190 (e.g., operatively coupled to and controlled by controller 156). Alternatively, guide-rails 188 may be mechanically driven by a separate mechanical slide or lever.

In certain embodiments, movement of the drawer liner 160 can be linked, at least in part, to movement of the secondary door 174. For instance, rotation of secondary door 174 toward the lowered position (e.g., past a predetermined rotational position about the horizontal axis AH from the lifted position) directs the drawer liner 160 to the expanded position. Additionally or alternatively, rotation of secondary door 174 toward the lifted position (e.g., past a predetermined rotational position about the horizontal axis AH from the lower position) direct the drawer liner 160 to the contracted position. Optionally, controller 156 may be configured to detect or monitor the rotational position of secondary door 174 (e.g., about horizontal axis AH) and initiate movement of the drawer liner 160 based on the detected rotational position.

In additional or alternative embodiments, movement of the drawer liner 160 can be linked, at least in part, to a detected condition apart from secondary door 174. For instance, microwave appliance 100 may further include a temperature sensor 192 (e.g., thermocouple, thermistor, etc.) operably coupled to controller 156 and configured to detect a temperature adjacent to microwave appliance 100. As illustrated, temperature sensor 192 may be attached to cabinet 110, such as at or on base wall 164. Controller 156 may further be configured to detect a temperature threshold (e.g., maximum temperature). If and when the temperature threshold is detected, such as might occur when a burner or element of a range beneath microwave appliance 100 is activated, controller 156 may initiate movement or otherwise direct drawer liner 160 to the contracted position.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A microwave appliance mountable over a cooktop appliance comprising a cooktop surface, the microwave appliance defining a vertical direction, a lateral direction, and a transverse direction, the microwave appliance comprising:

a cabinet defining a primary cooking chamber;

a magnetron mounted within the cabinet in communication with the primary cooking chamber to direct a microwave thereto;

a drawer liner having a side wall joined to a base wall, the drawer liner being slidably mounted to the cabinet to move along the vertical direction between a contracted position and an expanded position, the side wall being received within the cabinet in the contracted position, and the side wall defining a secondary cooking chamber with the base wall below the primary cooking chamber in the expanded position;

a primary door pivotably mounted to the cabinet to selectively cover the primary cooking chamber; and a secondary door movably mounted on the cabinet to move between an lifted position in contact with the primary door and a lowered position covering the secondary cooking chamber below the primary door.

2. The microwave appliance of claim 1, further comprising a heating element positioned below the primary cooking chamber, the heating element being isolated from the primary cooking chamber in thermal communication with the secondary cooking chamber.

3. The microwave appliance of claim 2, further comprising a secondary chamber fan in fluid communication with the secondary cooking chamber to recirculate air therethrough.

4. The microwave appliance of claim 1, wherein movement of the secondary door to the lowered position directs the drawer liner to the expanded position.

5. The microwave appliance of claim 1, wherein the primary door is pivotable about a vertical axis, and wherein the secondary door is pivotable about a horizontal axis.

6. The microwave appliance of claim 5, further comprising a support frame pivotably mounted below the primary door to rotate about the vertical axis, wherein the horizontal axis is defined by the support frame.

7. The microwave appliance of claim 1, wherein the drawer liner defines a ventilation inlet in fluid communication with the cabinet to direct an ambient airflow thereto.

8. The microwave appliance of claim 1, wherein the cabinet defines an outlet aperture above the secondary cooking chamber and in fluid communication therewith to direct an exhaust flow from the secondary cooking chamber.

9. The microwave appliance of claim 1, further comprising:

a controller mounted to the cabinet; and a temperature sensor operably coupled to the controller, wherein the controller is configured to initiate movement of the drawer liner to the contracted position in response to a temperature threshold detected at the temperature sensor.

10. A microwave appliance mountable over a cooktop appliance comprising a cooktop surface, the microwave appliance defining a vertical direction, a lateral direction, and a transverse direction, the microwave appliance comprising:

a cabinet defining a primary cooking chamber;

a magnetron mounted within the cabinet in communication with the primary cooking chamber to direct a microwave thereto;

a drawer liner having a side wall joined to a base wall, the drawer liner being mounted to the cabinet, and the side wall defining a secondary cooking chamber with the base wall below the primary cooking chamber;

a primary door pivotably mounted to the cabinet to selectively cover the primary cooking chamber; and a secondary door movably mounted on the cabinet to move between a lifted position in contact with the primary door and a lowered position covering the secondary cooking chamber below the primary door.

11. The microwave appliance of claim 10, further comprising a heating element positioned below the primary cooking chamber, the heating element being isolated from the primary cooking chamber in thermal communication with the secondary cooking chamber.

12. The microwave appliance of claim 11, further comprising a secondary chamber fan in fluid communication with the secondary cooking chamber to recirculate air therethrough.

13. The microwave appliance of claim 10, wherein movement of the secondary door to the lowered position directs vertical movement of the drawer liner below the cabinet.

14. The microwave appliance of claim 10, wherein the primary door is pivotable about a vertical axis, and wherein the secondary door is pivotable about a horizontal axis.

15. The microwave appliance of claim 14, further comprising a support frame pivotably mounted below the primary door to rotate about the vertical axis, wherein the horizontal axis is defined by the support frame.

16. The microwave appliance of claim 10, wherein the drawer liner defines a ventilation inlet in fluid communication with the cabinet to direct an ambient airflow thereto.

17. The microwave appliance of claim 10, wherein the cabinet defines an outlet aperture above the secondary cooking chamber and in fluid communication therewith to direct an exhaust flow from the secondary cooking chamber.

18. The microwave appliance of claim 10, further comprising:

a controller mounted to the cabinet; and a temperature sensor operably coupled to the controller, wherein the drawer liner is slidably mounted to the cabinet to move along the vertical direction between a contracted position and an expanded position, wherein the side wall is received within the cabinet in the contracted position, wherein the side wall defines the secondary cooking chamber with the base wall below the primary cooking chamber in the expanded position, and wherein the controller is configured to initiate movement of the drawer liner to the contracted position in response to a temperature threshold detected at the temperature sensor.

19. A microwave appliance mountable over a cooktop appliance comprising a cooktop surface, the microwave appliance defining a vertical direction, a lateral direction, and a transverse direction, the microwave appliance comprising:

a cabinet defining a primary cooking chamber;

a magnetron mounted within the cabinet in communication with the primary cooking chamber to direct a microwave thereto;

a drawer liner having a side wall joined to a base wall, the drawer liner being slidably mounted to the cabinet to move along the vertical direction between a contracted position and an expanded position, the side wall being received within the cabinet in the contracted position, and the side wall defining a secondary cooking chamber with the base wall below the primary cooking chamber in the expanded position;

a primary door pivotably mounted to the cabinet to selectively cover the primary cooking chamber; and a secondary door movably mounted on the cabinet to move between a lifted position and a lowered position below the lifted position, the lowered position covering the secondary cooking chamber below the primary door.

20. The microwave appliance of claim 19, further comprising a non-dielectric heater positioned below the primary cooking chamber in thermal communication with the secondary cooking chamber.

* * * * *